United States Patent [19]

Paliwoda et al.

[11] Patent Number: 4,925,367

[45] Date of Patent: May 15, 1990

[54] ENGINE BLOCK WATER PUMP ASSEMBLY

[75] Inventors: Joseph Paliwoda, West Bloomfield; Keith F. Hale; Verle Propst, both of Rochester Hills, all of Mich.

[73] Assignee: Deco-Grand, Inc., Royal Oak, Mich.

[21] Appl. No.: 354,234

[22] Filed: May 19, 1989

[51] Int. Cl.[5] ..... F01P 5/12

[52] U.S. Cl. ..... 415/213.1; 415/214.1; 123/509; 417/356

[58] Field of Search ..... 415/213.1, 214.1, 229, 415/203, 201, 104, 142, 170.1, 122.1; 123/198 C, 509, 41.49, 41.65, 41.66; 417/364; 416/60, 169 A

[56] References Cited

U.S. PATENT DOCUMENTS

| | | | |
|---|---|---|---|
| 1,863,213 | 6/1932 | Wintroath | 415/213.1 |
| 2,611,322 | 9/1952 | Wahle | 415/203 |
| 2,972,963 | 2/1961 | Hamilton | 415/213.1 |
| 3,133,506 | 5/1964 | Luciani | 418/206 |
| 3,373,927 | 3/1968 | Miller | 415/170.1 |
| 3,656,861 | 4/1972 | Zagar | 415/214.1 |
| 3,711,218 | 1/1973 | Kennel et al. | 415/214.1 |
| 3,713,749 | 1/1973 | Fitch | 415/201 |
| 3,788,762 | 1/1974 | Partos | 415/229 |
| 4,152,096 | 5/1979 | Murakami et al. | 415/214.1 |
| 4,183,713 | 1/1980 | Erickson et al. | 415/104 |
| 4,198,935 | 4/1980 | Seibt et al. | 123/198 C |
| 4,543,037 | 9/1985 | Etsion | 415/203 |
| 4,827,881 | 5/1989 | Baker et al. | 123/198 C |

*Primary Examiner*—Robert E. Garrett
*Assistant Examiner*—Hoang Nguyen
*Attorney, Agent, or Firm*—Harness, Dickey & Pierce

[57] ABSTRACT

The rotating parts of a vehicle engine water pump are assembled directly upon the engine block so that the block forms the pump housing. The pump parts include a drive wheel, such as a pulley or sprocket wheel, mounted upon one end of a drive shaft, with a pump impeller mounted upon the opposite end of the shaft. An open cavity is formed in the block to receive the impeller. A cover, having a central opening through which the shaft extends, covers the impeller and cavity and is sealed against the block, around the cavity, so that the cover and block together form a complete, sealed housing. The shaft is rotatably connected to the block, within the cavity, and the drive wheel is located on the outside of the cover, adjacent the block, for connection to a belt or chain from the power supply.

14 Claims, 2 Drawing Sheets

ENGINE BLOCK WATER PUMP ASSEMBLY

BACKGROUND OF INVENTION

Internal combustion engines, such as those typically used with automotive vehicles, include a massive engine block within which the engine cylinders are formed. Typically, the block is water cooled by means of forming passageways through the block and pumping coolant liquid through the passageways. Usually, the coolant is formed of a mixture of water and an anti-freeze additive and the like.

In conventional engines, a water pump is mounted on brackets which are, in turn, mounted either upon the engine or, more usually, within the engine compartment of the vehicle. These water pumps, in general, comprise a rotating impeller, shaped like a fan, mounted upon a shaft which also carries a drive wheel. The impeller is sealed within a pump housing. The wheel is located outside of the housing for connection to a suitable belt or chain or gear drive which connects to a power source. Inlet and outlet openings are formed in the pump housing and suitable hoses or tubing connect these openings to the engine block coolant passageways. Thus, coolant liquid or water from the engine block coolant passageways flow into the pump housing and are forced outwardly of the pump housing by the rotating impeller blades to return to the engine block coolant passageways.

Although modern water pumps are relatively small in size, nevertheless, such pumps and their mounting brackets do require space within the engine compartment where space is at a premium. In addition, a number of parts, including brackets, are required for mounting the pump and connecting it to the engine. These parts, and the pump housing itself, are relatively expensive. Thus, efforts have been made in the past to simplify such water pump constructions and to reduce the number of mounting parts particularly for automotive vehicle engine uses.

The invention herein concerns a simplified water pump construction which utilizes the engine block itself as a portion of the pump housing so as to reduce the number of pump and pump mounting parts and, to reduce the amount of space required in the engine compartment for the water pump.

SUMMARY OF INVENTION

The invention herein contemplates utilizing a portion of a conventional engine block as a portion of the water pump housing. That is, the invention contemplates forming an open cavity or a wall surface which is integral with the conventional engine block and which is located at a suitably thick portion of the engine block for enclosing the pump impeller. A cover is arranged over the open cavity and impeller and is sealed directly to the engine block around the cavity. The impeller drive shaft extends through an opening in the cover for connection to a conventional drive pulley or sprocket wheel or gear which is located outside of the cover. Consequently, since a substantial portion of the pump housing is integral with the engine block, mounting brackets are eliminated and the amount of engine compartment space for the pump is substantially reduced.

One object of this invention is to reduce the amount of space needed for an internal combustion engine water pump by mounting the rotating impeller of the water pump directly upon and partially within the engine block in a manner which permits the pump rotating parts to be easily assembled or removed for repair and replacement when required.

Another object of this invention is to simplify the water pump housing construction for an automotive vehicle type of engine by mounting the pump rotating parts directly upon the engine block.

Still a further object of this invention is to materially reduce the expense of an automotive type engine water pump by eliminating much of the pump housing, the support brackets, hose connections, and the like. That is, the engine block may be formed with a suitable pump mounting area when the block is cast so that with minimal machining, it forms a portion of the pump assembly.

These and other objects and advantages will become apparent upon reading the following description, of which the attached drawings form a part.

DETAILED DESCRIPTION

Figure 1:
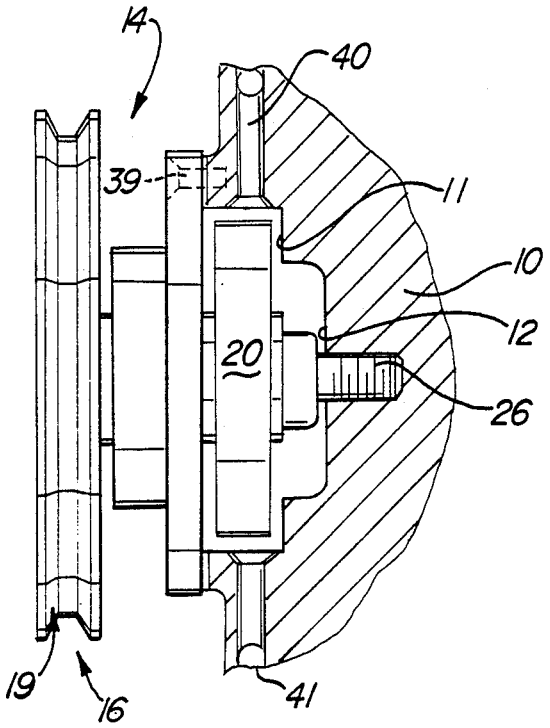
FIG. 1 is a fragmentary view of a portion of an engine block with a pump assembled in position.
Figure 2:
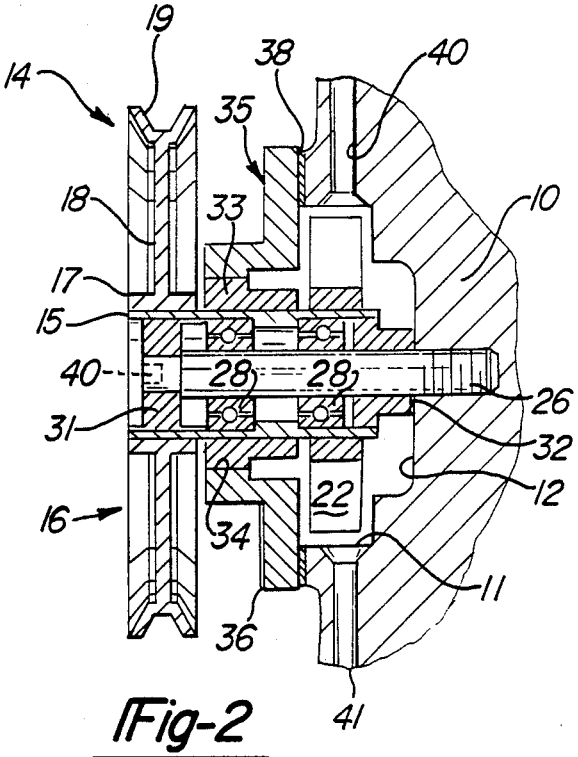
FIG. 2 is a view similar to FIG. 1, but showing the pump in cross-section.
Figure 3:
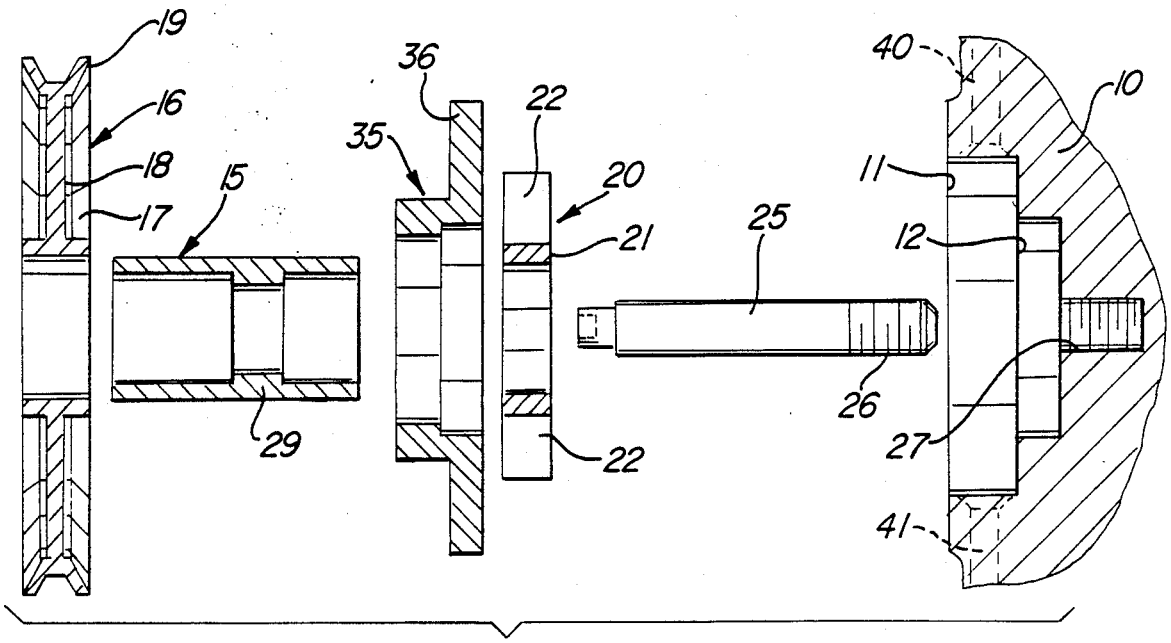
FIG. 3 is a disassembled view showing the major portions of the pump adjacent a fragment of the block within which the pump is assembled, with the seals and bearings omitted for clarity.

FIGS. 1–3 schematically illustrate a cross-sectional, fragmentary part of an engine block 10. A cavity 11 is formed in the block. The cavity may have a smaller, inward cavity portion 12 or may be otherwise shaped as appropriate for a particular pump assembly. The cavity opens to the exterior of the engine block surface.

The pump 14 includes a tubular shaft 15 having a drive wheel, such as a pulley 16 or sprocket or gear mounted upon one end thereof. The pulley has a central hub 17, a surrounding spider 18 and a channelled rim 19 for receiving a drive belt or chain.

A conventional impeller 20 is arranged with its hub 21 mounted upon the tubular shaft 15. The impeller fan blades 22, which are shown schematically, are enclosed within the peripheral, annular wall which defines the cavity 11 in the engine block.

The tubular shaft 15 is arranged around a fixed shaft or rod 25 which has a threaded end 26. The threaded end is threadedly engaged within a correspondingly threaded socket 27 formed within the cavity of the engine block.

A pair of bearings 28 surround the fixed shaft or rod 25 and are arranged within the interior of the tubular shaft 15 to permit relative rotation of the shafts. In order to maintain the bearings in proper position, an enlargement or shoulder 29 may be formed within the interior of the threaded shaft (see FIG. 3).

A conventional, circular seal 31 is installed within the pulley hub 17 and around the fixed shaft 25. Similarly, a generally L-shaped, in cross-section, seal 32 is arranged around the fixed shaft and within the interior of the tubular shaft inside of the block cavity 11. An outer, annular, L-shaped in cross-section seal 33 surrounds the exterior of the tubular shaft 15 and seals it against the interior edge of an opening 34 formed within a plate-like cover 35. This cover has a flange 36 that seals against an annular surface or seat 37 formed on the engine block area surrounding the cavity opening. Preferably, a gasket 38 may be positioned between the cover flange 36 and the annular seat 37. Suitable screws 39 or the like mechanical fasteners may be utilized to fasten the cover upon the engine block.

In operation, the pump parts may be preassembled, as shown in FIG. 2, and the fixed shaft may then be threadedly engaged within the threaded socket in the cavity. To assist in making the threaded engagement, a wrench engaging slot or socket 40 may be formed in the outer end of the fixed shaft.

Inlet and outlet passageways 41 and 42 may be formed in the engine block, as schematically illustrated in FIGS. 2 and 3. The arrangement and sizes and shapes of the fluid passageways may vary considerably, depending upon the nature of the engine, the amount and location of the fluid flow desired, etc.

Figure 4:
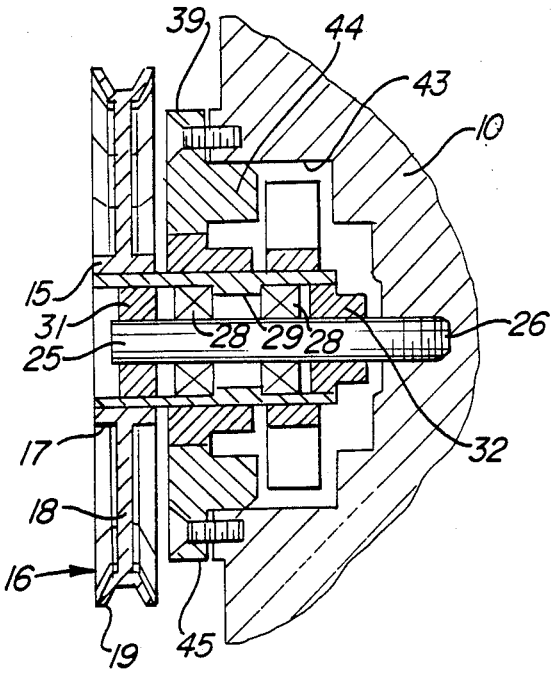
FIG. 4 is a cross-sectional view, similar to FIG. 2, showing a modification.

FIG. 4 illustrates a modification which is similar in construction to the modification of FIG. 2 except that the cavity 43 is considerably deeper. A relatively thick annular plug 44 is formed integral with the cover 45 for insertion within and sealing against the annular wall defining the interior of the cavity.

Figure 5:
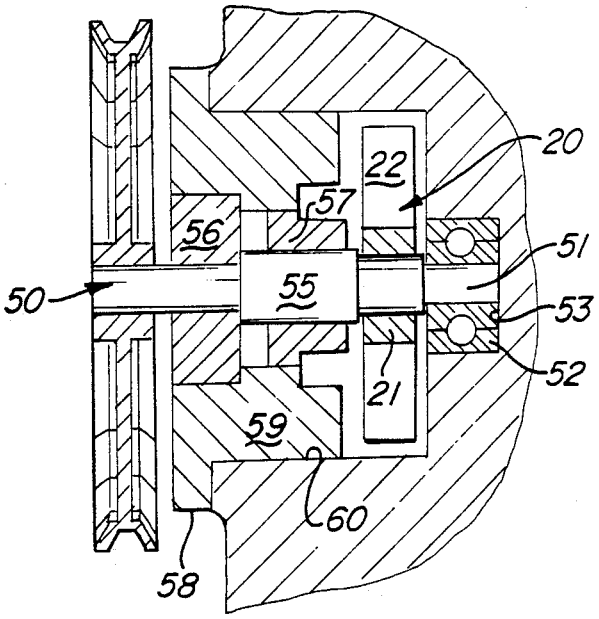
FIG. 5 is a cross-sectional view showing a second modification.

FIG. 5 illustrates a second modification wherein the hub of the pulley and the hub of the impeller are mounted upon a solid shaft 50. The shaft has an inner end extension 51 which fits within a bearing 52 inserted within a socket 53 formed in the base of the cavity. Thus, the shaft 50 rotates and is rotatably fastened within the cavity and to the block by means of the rotating connection between its end portion 51 and the bearing 52.

The center part of the shaft may be enlarged at 54 to provide a shoulder against which the hub 21 of the impeller 20 may be positioned.

A pair of seals 56 and 57 are arranged around the shaft for sealing the shaft to the interior of a cover 58 which has a plug portion 59 that fits into the enlarged cavity 60. One of the seals 56 may be a simple annular or doughnut shaped seal 56 and the other seal 57 may be L-shaped in cross-section, as schematically illustrated.

Figure 6:
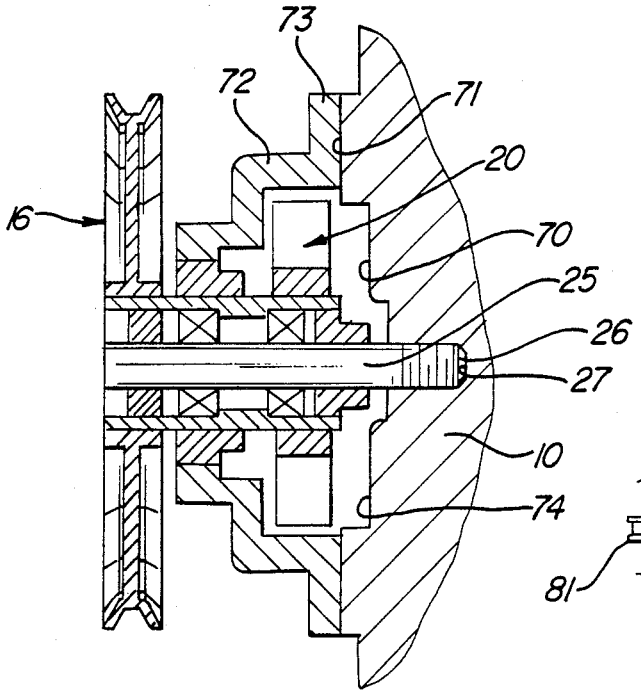
FIG. 6 is a cross-sectional view showing a third modification.

FIG. 6 illustrates a third modification wherein the cavity 70 may be shallower and smaller in size so that the impeller 20 is located outside of the cavity, parallel to and adjacent to the exterior wall surface 71 of the block. The cover 72 is dish-like in configuration so that it surrounds the peripheral edge of the impeller in addition to having its flange 73 sealed against the surface of the block. Here, the cover forms more of the housing than the covers of the prior mentioned modifications.

As in the case of other modification of FIGS. 1-3, a tubular shaft 15 is used for supporting the impeller 20 and the pulley 16. The tubular shaft is mounted, by means of bearings and seals similar, to that disclosed in FIGS. 1-3, upon a fixed shaft or rod 25 which has a threaded end 26 connected within a threaded socket 27 within the cavity 74 of the block 10.

Figure 7:
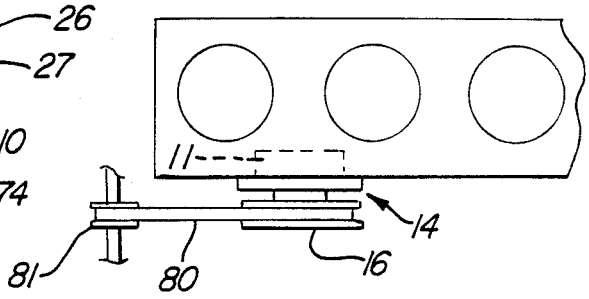
FIG. 7 is a fragmentary, schematic view showing thelocation of the pump in an engine block.

FIG. 7 schematically shows that the cavity 11 may be located at any convenient place on the engine block where there is sufficient wall thickness to accommodate the cavity. The pump may then be inserted within the cavity, as schematically shown, and a suitable drive belt or drive chain 80 may be applied around the pulley or sprocket 16 and connected to a suitable pulley or sprocket 81 which may be conventionally powered by a connection to the engine.

This invention may be further developed within the scope of the following claims. Therefore, having fully described at least one operative embodiment of this invention, it is now claimed:

We claim:

1. A vehicle engine water pump assembly comprising:

an engine block having a cavity formed in an external. exposed, block surface, with the cavity opening outwardly of the block surface and being defined by a peripheral wall surface and a base surface within the block;

a pump having a rotatable shaft with an impeller mounted at one end of the shaft and a drive wheel mounted at the other end of the shaft so that rotation of the drive wheel rotates the impeller therewith, said shaft being formed as a hollow tube;

a rigid rod extending through the tube and rotatably supporting the tube, with the rod having an end portion which extends through the cavity base surface and is rigidly secured to the engine block;

at least a portion of said impeller and the shaft portion upon which the impeller is mounted being located in the block cavity; the remainder of the shaft extending outwardly of the cavity opening, with the drive wheel being located outside of the cavity and adjacent the block surface;

a cover having a central opening through which the shaft extends, with the cover closing the cavity opening and being sealed to the block surface around the cavity opening;

sealing means for rotatably sealing the shaft to the cover;

whereby the engine block cavity defining wall and base surface together with the cover from a sealed housing for the water pump.

2. A vehicle engine water pump assembly as defined in claim 1, and with the external periphery of said impeller being completely surrounded by said cavity defining peripheral wall surface.

3. A vehicle engine water pump assembly as defined in claim 1, and including rotating bearing means surrounding the rod and arranged within the tube for rotatably mounting the tube upon the rod.

4. A vehicle engine water pump assembly as defined in claim 3, and said rod end portion being formed with threads which are threadedly engaged within a correspondingly threaded socket formed in the cavity base surface.

5. A vehicle engine water pump assembly as defined in claim 4, and including the external periphery of said impeller being completely surrounded by said cavity defining peripheral wall surface.

6. A vehicle engine water pump assembly as defined in claim 1, and including a depressed socket formed within the cavity base surface, and said shaft having an end portion rotatably held within said socket.

7. A vehicle engine water pump assembly as defined in claim 6, and including bearing means located between the cover, within its central opening, and around the shaft for rotatably securing the shaft within the cover.

8. A pump assembly comprising:

a rotatable shaft having a pump impeller on one end portion and a drive wheel on its opposite end portion so that the shaft, impeller and drive wheel may be rotated as a unit when rotational power is applied to other drive wheel, said shaft being formed as a hollow tube;

a rigid rod extending through the tube and rotatably supporting the tube, with the rod having an end portion which is rigidly secured to a massive support member, such as a vehicle engine block and the like, having an exposed housing wall defining surface;

said impeller being positioned adjacent said housing wall defining surface with the shaft impeller mounted end portion being rotatably connected to the support member and the drive wheel being located externally of the support member and spaced from said housing wall defining surface;

a cover having a central opening through which the shaft is extended, and having sealing means sealing the peripheral edge portions of the cover to the support member around the housing wall defining surface so that the cover and the wall defining surface together form a housing which sealingly encloses the impeller and the portion of the shaft upon which the impeller is mounted, with the drive wheel and shaft drive wheel end portion being located outwardly of the cover adjacent the support member for connecting a power supply means to the drive wheel for rotating the shaft and impeller;

and said shaft being rotatably sealed to the cover;

whereby at least a substantial portion of the pump housing is formed by and, therefore, is integral with the support member.

9. A pump assembly as defined in claim 8, and said housing wall defining surface being provided by the peripheral wall and the base of a depressed, open cavity formed in the support member, with the cover being sealed to the continuous area of the support member which surrounds the cavity opening and defines the cavity opening, and the impeller being located adjacent the cavity base with its periphery adjacent the cavity peripheral wall.

10. A pump assembly as defined in claim 8, and with said rod end portion being formed with threads that are threadedly engaged within a correspondingly threaded socket formed in the cavity base surface.

11. A pump assembly as defined in claim 8, and said housing wall defining surface being provided by a substantially planar surface formed on the exterior of the support member, with the impeller arranged parallel to and closely adjacent said planar surface;

said cover extending around the periphery of the impeller and having a continuous edge flange engaged against the planar surface around the impeller.

12. A pump assembly as defined in claim 11, and with said shaft being formed as a hollow tube with a rigid rod extending through the tube and rotatably supporting the tube; said rod having an end portion that is rigidly secured to the support member.

13. A pump assembly as defined in claim 12, and said rod end portion being formed with threads that are threadedly fastened within a correspondingly threaded socket formed in the support member.

14. A pump assembly as defined in claim 13, and including rotating bearing means surrounding the rod and arranged within the tube for rotatably mounting the tube upon the rod;

annular sealing means surrounding the tube and arranged within the cover opening for sealing the tube to the cover.

* * * * *

UNITED STATES PATENT AND TRADEMARK OFFICE

CERTIFICATE OF CORRECTION

PATENT NO. : 4,925,367

DATED : May 15, 1990

INVENTOR(S) : Joseph Paliwoda, et al

It is certified that error appears in the above-identified patent and that said Letters Patent is hereby corrected as shown below:

In claim 1, col. 4, line 40: change "from" to --form--

In claim 11, col. 6, line 18: after "flange" add --sealingly--

Signed and Sealed this

First Day of October, 1991

*Attest:*

HARRY F. MANBECK, JR.

*Attesting Officer*

*Commissioner of Patents and Trademarks*